United States Patent [19]

Huibers et al.

[11] 4,437,973

[45] Mar. 20, 1984

[54] COAL HYDROGENATION PROCESS WITH DIRECT COAL FEED AND IMPROVED RESIDUUM CONVERSION

[75] Inventors: Derk T. A. Huibers, Pennington; Paul H. Kydd, Lawrenceville, both of N.J.

[73] Assignee: HRI, Inc., Gibbsboro, N.J.

[21] Appl. No.: 365,660

[22] Filed: Apr. 5, 1982

[51] Int. Cl.[3] ..... C10G 1/08

[52] U.S. Cl. ..... 208/10; 208/8 LE

[58] Field of Search ..... 208/10, 8 LE

[56] References Cited

U.S. PATENT DOCUMENTS

| | | | |
|---|---|---|---|
| 1,950,309 | 3/1934 | Jennings | 208/10 |
| 2,753,296 | 7/1956 | Sellers | 208/10 |
| 3,619,404 | 11/1971 | Rieve et al. | 208/10 |
| 3,775,071 | 11/1973 | Hoffert et al. | 208/8 R |
| 4,040,957 | 8/1977 | Sze et al. | 208/8 LE |
| 4,049,536 | 9/1977 | Plumlee et al. | 208/8 LE |
| 4,111,788 | 10/1978 | Chervenak et al. | 208/10 |
| 4,189,374 | 2/1980 | Kirby et al. | 208/10 |
| 4,211,631 | 7/1980 | Carr et al. | 208/10 |
| 4,298,453 | 11/1981 | Schoennagel et al. | 208/10 |

*Primary Examiner*—Delbert E. Gantz

*Assistant Examiner*—Lance Johnson

*Attorney, Agent, or Firm*—Vincent A. Mallare; Fred A. Wilson

[57] ABSTRACT

A process for hydrogenation of coal to produce hydrocarbon liquids and gases, wherein the yield of liquid products is increased by feeding particulate coal at temperature below about 600° F. directly into a back-mixed reactor and preferably into an ebullated bed catalytic reaction zone containing coal-derived liquid and hydrogen for rapid heating and conversion. In the process, the coal is pressurized and fed without preheating directly into the reaction zone and additional heat needed in the reaction zone to maintain temperature therein at 750°-900° F. is provided by heating recycle hydrogen and coal-derived liquid streams to temperatures above the desired reaction zone temperature. By using this process, the coal feed is heated quickly and hydrogenated in the catalytic reaction zone and undesired thermal reactions which usually occur in coal during preheating before its exposure to the catalytic hydrogenation reaction zone conditions are minimized, which results in increased yields of desirable light hydrocarbon liquids products and reduced production of undesirable asphaltenes and unconverted coal or char.

23 Claims, 2 Drawing Figures

VENT
COAL
$H_2$
10
12
13
14
15
16
17
18
18a
19
19a
20
21
22
22a
23
24
25
26
27
28
30
31
32
33
34
35
36
37
38
40
41
42
43
44
45
46
47
48
49
50
52
53
54
55
56
57
58
59

COAL HYDROGENATION PROCESS WITH DIRECT COAL FEED AND IMPROVED RESIDUUM CONVERSION

BACKGROUND OF INVENTION

This invention pertains to a coal hydrogenation process in which particulate coal is introduced without preheating directly into a reaction zone preferably containing an ebullated catalyst bed, and the coal is rapidly heated and catalytically hydrogenated therein to provide increased percentage conversion and improved yields of hydrocarbon liquid products.

In the present H-Coal TM coal hydrogenation process, particulate coal is slurried in a coal-derived recycle oil and the coal-oil slurry is preheated to a temperature near reaction temperature before feeding it into an ebullated bed catalytic reactor. During the preheating step a major portion of the coal dissolves and a large fraction of the initial coal liquefaction product is residual oil containing preasphaltenes and asphaltene compounds. For example, initial liquefaction of Wyodak subbituminous coal produces about 46 W % residual oil (14% preasphaltenes and 32% asphaltenes), and Illinois No. 6 bituminous coal produces about 64 W % residual oil (36% preasphaltenes and 28% asphaltenes). The preasphaltenes are highly unstable species at elevated temperatures, and can decompose thermally in the presence of hydrogen to form asphaltenes while releasing gaseous hydrocarbons and water, but they can also rearrange, aromatize, and even condense to form char. It is believed that at least part of the material that is observed as unconverted coal or char from a coal catalytic reaction process is char formed from preasphaltenes.

Conventional processes for coal liquefaction and hydrogenation which include a thermal treatment step for the coal-oil slurry prior to the catalytic reaction step are generally disclosed in U.S. Pat. Nos. 3,519,555; 3,700,584; 3,791,957 and 4,111,788. Also, U.S. Pat. No. 3,775,071 to Hoffert, et al discloses feeding dry coal in particulate form to a pressurized ebullated bed catalyst reactor, but does not disclose any feed for limiting the temperature of the coal feed during such pressurizing. Other coal hydrogenation processes use diposable catalyst at plug flow conditions and low solvent/coal ratios, such as U.S. Pat. Nos. 4,090,943 and 4,102,775. In these processes, the coal is heated to near the reaction temperature before feeding it into the catalytic reaction zone.

In Flash hydropyrolysis of coal, as disclosed by Schroeder in U.S. Pat. No. 3,030,297, it is stated that 90% conversion of coal to liquid and gas products can be obtained by heating the coal to about 800° C. (1472° F.) in 2–20 seconds at a hydrogen partial pressure of 500–6000 psi. The liquid produced comprises 30%–60% of the coal and is said to be a light aromatic distillate. U.S. Pat. No. 3,960,700 to Rosen, et al discloses contacting Wyoming Big Horn subbituminous coal with hydrogen at 840° F. for 0.5 seconds, and producing 46% benzene, 12% methane, 4% ethane, and 14% char. Kentucky No. 11 coal similarly processed yielded 40% BTX materials. Also, U.S. Pat. No. 3,488,280 to Schulman discloses catalytic hydrogenation of coal with water recycle, wherein coal together with solvent and catalyst are introduced directly into the reactor. Although some work on coal hydrogenation processes utilizing rapid heating of coal with hydrogen have been disclosed in the above listed patents, these processes do not provide for high conversion of the coal and, and thus, further process improvements in rapid heating and catalytic conversion of coal to form increased yields of desirable liquid products are needed.

SUMMARY OF INVENTION

The present invention provides a process for hydrogenation of coal to produce hydrocarbon liquid and gaseous products, in which the process comprises feeding particulate coal at temperature below about 600° F. directly without further preheating into a pressurized back-mixed reaction zone containing coal-derived liquid normally boiling above about 550° F. and dissolved hydrogen. The coal feed along with a recycled coal-derived liquid and recycled hydrogen are passed upwardly through the reaction zone, which is maintained at 700°–950° F. temperature and 1000–5000 psig hydrogen partial pressure. The coal is heated very rapidly to the desired reaction zone temperature, which is maintained by heating the recycled coal-derived 550° F.+ liquid and recycled hydrogen to a temperature adequate to maintain the desired reaction zone temperature, and introducing these heated recycle streams into the lower portion of the reaction zone. The reaction zone preferably contains an ebullated bed of hydrogenation catalyst.

The hydrogenated coal-derived material containing liquid and vapor fractions are withdrawn from the upper portion of the reaction zone, and are phase separated to produce the hydrocarbon liquid and gas products. The particulate coal can be fed into the reaction zone either as a pressurized slurry with a coal-derived liquid, or as an extruded mixture of dry coal mixed with a small stream of recycled coal-derived liquid.

DETAILED DESCRIPTION OF INVENTION

In the present invention, a coal hydrogenation process is described in which particulate coal at temperature below about 600° F., and preferably at 400°–575° F. temperature, is pressurized and introduced directly without a preheating step into a pressurized reaction zone containing coal-derived liquid, hydrogen, and preferably an ebullated bed of particulate catalyst. The coal is heated very rapidly therein to the desired reaction temperature of 700°–950° F. Because the usual separate preheating step for the coal feed such as to 600°–800° F. is omitted in the present process, additional heat needed to maintain the desired liquid temperature in the reaction zone is provided by heating recycled hydrogen and a recycled coal-derived liquid stream to temperatures sufficiently above the reaction zone temperature.

By introducing the particulate coal feed directly into the catalytic reaction zone and heating the coal rapidly therein in the presence of coal-derived liquid and hydrogen and a preferably hydrogenation catalyst, improved catalytic conversion of the coal to produce hydrocarbon liquids and gases is achieved and formation of undesired char is substantially reduced or even avoided. The presence of very active hydrogen donor solvent compounds formed on the catalyst, and the use of an active hydrogenation catalyst that can convert preasphaltenes 3 to 7 times as fast as is possible thermally achieves such improved conversion of coal with only minimal char formation and with a minimal skeletal arrangement of the coal molecules. Thus, the yield of desirable low boiling hydrocarbon liquid products and aromatic compounds such as benzene, toluene and xylene in the product is greatly enhanced.

According to a diagram of a typical average structure of a preasphaltene derived from a Western Kentucky coal, it is of interest to note that although this structure is 73% aromatic and contains 8 aromatic rings, only one condensed structure is present (naphthalene). Thus, potentially up to about 75% of the product from a successful catalytic hydrocracking operation could be in the naphtha boiling range. It is also clear that, if this structure could be made to rearrange and loose hydrogen during the catalyst reaction, a considerable amount of consensed polyaromatics could also be formed.

Figure 1:
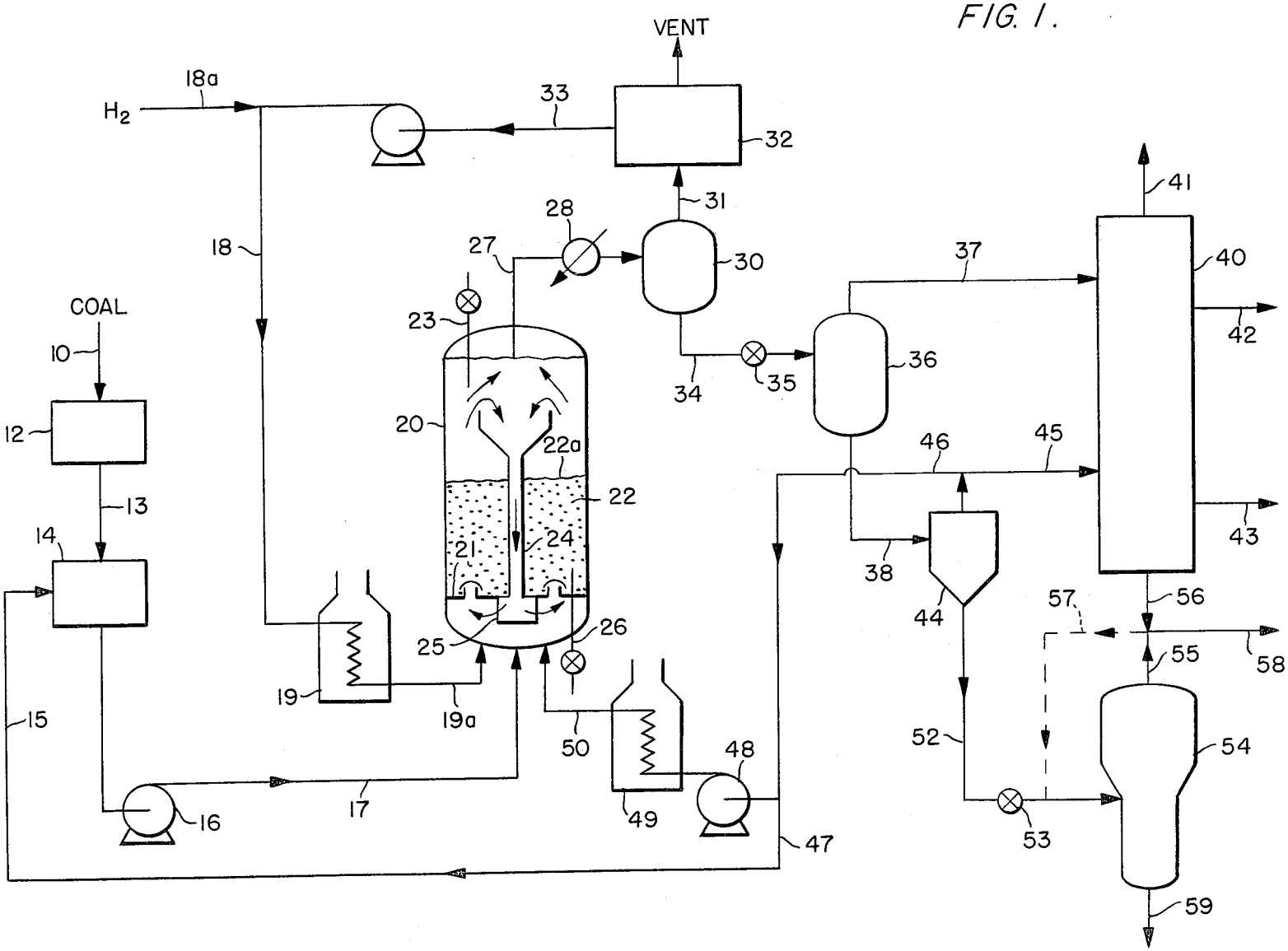
FIG. 1 is a schematic flow diagram of a catalytic coal hydrogenated process utilizing direct feeding of particulate coal to a catalytic reaction zone in accordance with the invention.

This invention will now be described as used in a coal hydrogenation process in which a coal-oil slurry is fed directly without preheating into a back-mixed type reactor and preferably an ebullated catalyst bed type reactor as generally illustrated by FIG. 1. As shown, a bituminous coal, such as Illinois No. 6 or semibituminous type coal such as Wyodak is provided at 10, and is passed through a preparation unit generally indicated at 12. In such a unit the coal is ground to a desired size range, screened for uniformity and dried to remove substantially all surface moisture. For our purposes, it is preferable that the coal have a particle size range of about 50 to 375 mesh (U.S. Sieve Series).

The coal fines are passed through conduit 13 to slurry tank 14, where the coal is blended with a slurrying oil at 15, which is derived in the process. To provide an effectively flowable coal-oil slurry, the ground coal should be mixed with about 0.5 to 1.5 part by weight of the slurrying oil. The resulting coal-oil slurry is pressurized by pump 16 to elevated pressure, such as 500–5000 psi, and is then passed through conduit 17 at coal temperature below 600° F. and preferably at 400°–575° F. directly into reactor 20. Recycled hydrogen at 18 is heated at 19 and provided to the reactor 20, together with fresh makeup hydrogen as needed at 18*a*.

The coal-oil slurry and hydrogen streams then enter reactor 20 containing catalyst bed 22, passing uniformly upwardly from the bottom through flow distributor 21 at flow rate and at temperature and pressure conditions to accomplish the desired hydrogenation reactions. The catalyst in bed 22 should be selected from the group consisting of cobalt, iron, molybdenum, nickel, tin, and other hydrocarbon hydrogenation catalyst metals known in the art, deposited on a base material selected from the group consisting of alumina, magnesia, silica, and similar materials. In addition, particulate hydrogenation catalyst may be added to reactor 20 at connections 23 in the ratio of about 0.1 to 2.0 pounds of catalyst per ton of coal processed.

By concurrently flowing liquid and gasiform materials upwardly through the reactor containing a bed of solid particles of specific catalyst as indicated above, and expanding the bed of solid particles by at least about 10%, and usually by 20–100% over its settled height the solid particles are placed in random ebullated motion within the reactor by the upflowing streams. The characteristics of the ebullated bed at a particular degree of volume expansion can be such that finer, lighter particulate solids will pass upwardly through the catalyst bed, so that the contact particles constituting the ebullated bed are retained in the reactor and the finer, lighter material pass from the reactor. The catalyst bed upper level 22*a*, above which few if any contact particles ascend, is the upper level of ebullation.

In general, the gross density of the mass of catalyst will be between about 25 to 200 pounds per cubic foot, the upward flow rate of the liquid will be between about 5 and 120 gallons per minute per square foot of horizontal cross-section area of the reactor, and the expanded volume of the ebullated bed usually will be not more than double the volume of the settled mass. To maintain the desired superficial upward liquid velocity in the reactor, a portion of the liquid slurry is usually recycled to the reactor, such as liquid which is removed from above the upper level of ebullation 22*a* and recycled via downcomer conduit 24 and pump 25 to the bottom of the reactor 20, and then upwardly through flow distributor 21. Spent catalyst may be removed by drawoff at connection 26 to maintain the desired catalytic activity within the reaction zone.

Reactor operating conditions are maintained in the ranges of 700°–930° F. temperature and 1000–5000 psi partial pressure of hydrogen, and preferably 750°–900° F. and 1000–4000 psi hydrogen partial pressure. Coal throughput or space velocity is in the range of 15 to 150 pounds coal per hour per cubic foot of reactor volume, so that the yield of unconverted coal as char is between about 5 and 15 W % of the moisture and ash-free coal feed. The relative size of the coal and catalyst particles and conditions of ebullation is such that catalyst is retained in the reactor, while ash and unreacted char particles are carried out with the liquid reaction products.

From reactor 20, an effluent stream 27, which is virtually free of solid catalyst particles is withdrawn, cooled at 28, and then passed to phase separator 30. From separator 30, a light gas fraction stream is removed at 31 and passed to hydrogen purification step 32. A medium-purity hydrogen stream 33 is recovered from purification step 32, warmed at heat exchanger 28, and recycled as stream 18 through heater 19 to reactor 20 to provide a part of the hydrogen requirements therein as heated hydrogen stream 19*a*.

From separator 30 a liquid fraction stream 34 is withdrawn, pressure-reduced at 35 and is passed to phase separator 36. This separator operates at near atmospheric pressure and 500°–650° F. temperature and permits removal of a light liquid stream at 37 and a heavy hydrocarbon liquid stream at 38. Stream 37 contains naphtha and light distillate fractions and is passed to fractionation step 40, from which hydrocarbon gas products are withdrawn at 31 and light distillate product at 42. A hydrogenated coal liquid fraction usually having normal boiling range above about 550° F. and preferably 600°–950° F. and containing asphaltenes, unconverted coal and ash solids, is withdrawn at 38 and is passed to liquid-solids separation step 44, such as hydroclones. An overflow 550° F+ liquid stream containing reduced concentration of solids is removed at 46, and is pressurized to reactor pressure at 48, reheated at 49 as needed usually heated to a temperature 10°–100° F. above the reactor temperature and recycled at 50 to reactor 20 to provide heat needed therein to help control the solids concentration in the reactor and to achieve further conversion and increased yields of low boiling hydrocarbon products. A portion 47 of liquid stream 46 provides the slurrying oil 15 needed to slurry mix tank 14.

The underflow liquid stream 52, containing an increased solids concentration, is removed from separation step 44 and passed to vacuum distillation at 54. The resulting overhead liquid 55 from the vacuum still may be joined with stream 56 to provide a heavy distillate product stream 58. If desired, at least a portion 57 of the stream 56 can be passed to vacuum distillation at 54. The heavy bottoms stream 59 from vacuum still 54 containing some asphaltenes and unconverted coal and ash solids may be further processed by coking to recover oil products or by gasification to produce the makeup hydrogen needed in the process.

Figure 2:
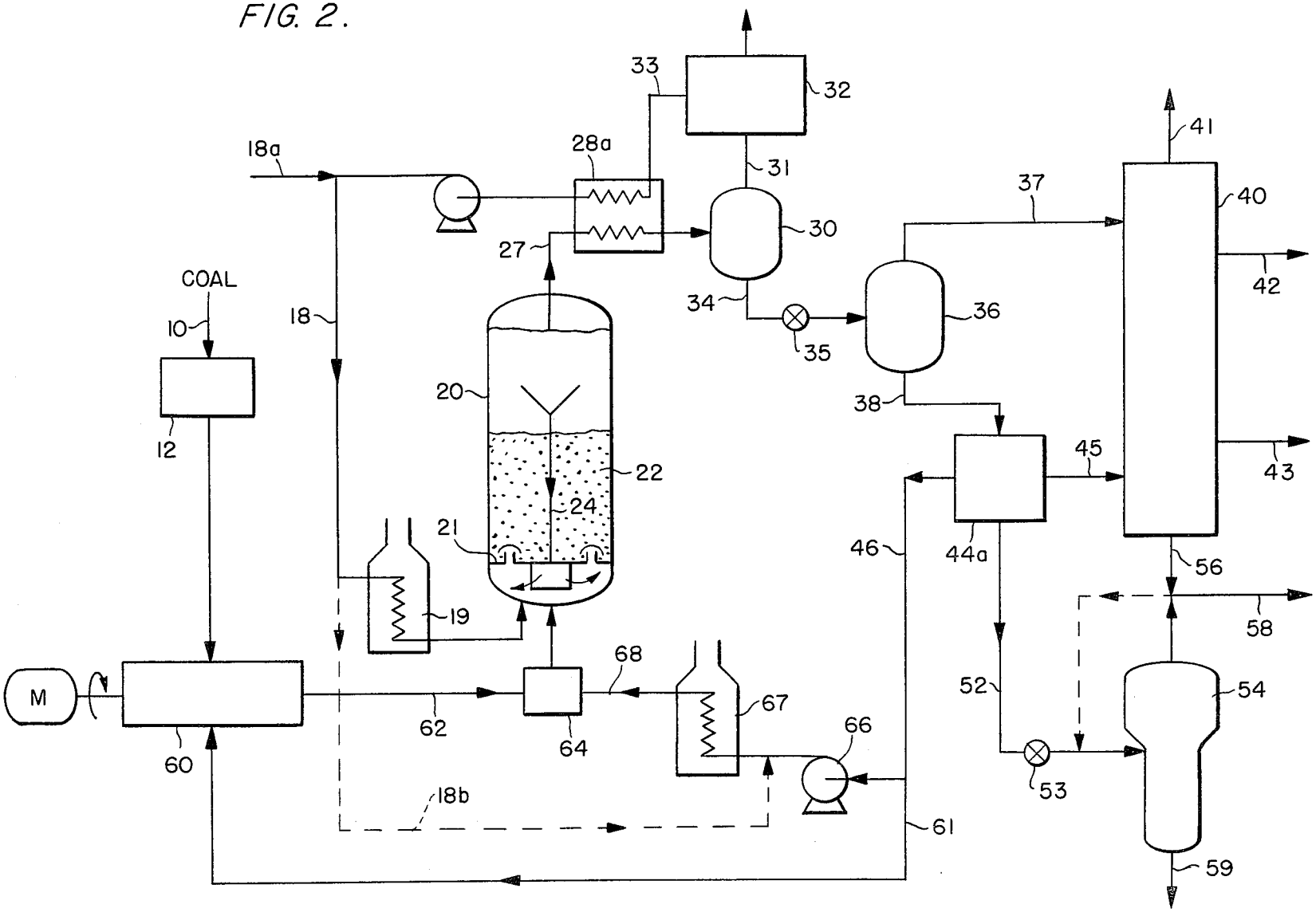
FIG. 2 is a schematic flow diagram of an alternative embodiment of a catalytic coal hydrogenation process utilizing the invention.

An alternative embodiment of the present invention is shown in FIG. 2, wherein the particulate coal feed is pressurized mechanically such as by an extruder or screw type feeder to reactor pressure and injected usually with a small percentage of carrying oil into the lower portion of the reaction zone at temperatures below about 650° F., and preferably at 400°-575° F. temperature. In this embodiment, a slurry mix tank is not required, and particulate coal at 10 is introduced into the inlet of rotary screw feeder 60. A minor amount of hydrocarbon liquid stream 61 can also be introduced into the screw feeder near its inlet end to provide a pressure seal and to facilitate pressuring the coal to reactor pressure. Such liquid 61 need comprise only about 0.1 of the coal on a weight basis, thus leaving more of recycle hydrocarbon liquid stream 46 to provide heat to the reactor 20 via pump 66 and heater 67. A cooling jacket can be provided around screw feeder 60 if necessary to maintain the coal temperature therein below about 600° F. Also if necessary or desirable, staged screw feeders or extruders 60 can be used for pressurizing the coal.

The pressurized coal at 62 can be mixed at mixer device 64 with pressurized oil at 68 to uniformly disperse the coal in a coal-oil slurry before feeding it into the lower end of reactor 20. Recycled hydrogen is heated at 18 and provided to the reactor at 19, together with fresh make-up hydrogen as needed at **18*a*. Alternatively, hydrogen 18 can be introduced as stream 18*b* upstream of heater 67, which increases the flow volume available for achieving uniform mixing of the coal and recycle oil in mixing step 64. In mixing device or step 64, the pressurized coal in substantially particulate form is introduced into flowing stream 68 for uniform mixing and feeding of the coal and oil mixture into a lower plenum of reactor 20 below flow distributor 21. Mixer 64 is preferably located adjacent the lower end of reactor 20**.

The pressurized coal and coal-derived recycled hydrocarbon liquid then enter the lower end of reactor 20 containing catalyst bed 22, and are passed through flow distributor 21 and uniformly upwardly at sufficient flow rate and at temperature and pressure selected to provide rapid heating of the coal and to accomplish the desired hydrogenation reactions. The reaction conditions and catalyst used are substantially the same as for FIG. 1 embodiment.

From reactor 20, effluent stream 27 is withdrawn and cooled at heat exchanger **28*a* against recycle hydrogen stream 33, and passed to phase separator 30. From separator 30, a light gas fraction stream is removed at 31 and passed to hydrogen purification step 32. Also, from separator 30, liquid stream 34 is withdrawn, pressure-reduced at 35 and is passed to low pressure phase separator 36 for further separation. Overhead stream 37 is passed to fractionation system 40 to produce hydrocarbon gas and liquid products similarly as for FIG. 1, and liquid stream 38 is passed to liquid-solids separation step 44*a***, which can be a solvent precipitation or filtration system, for removal of fine particulate solids of unconverted cool and ash.

From solids separation at **44*a*, hydrocarbon liquid normally boiling above about 650° F. and containing reduced concentration of solids is removed at 46, is pressurized to reactor pressure 66, reheated at 67 as needed and recycled at 68 to reactor 20 to provide incremental heat therein as needed. The remainder of the FIG. 2 embodiment process operates similarly to FIG. 1** and therefore that description need not be repeated.

This invention will be further described with reference to the following examples which should not be construed as limiting in scope.

EXAMPLE

Bituminous Illinois No. 6 coal in particulate form having −70 mesh particle size (U.S. Sieve Series) is slurried with sufficient coal-derived liquid having normal boiling range above about 550° F. in a slurry mix tank operating at 400°-575° F. temperature to form a flowable slurry. The coal-oil slurry is then pressurized by a pump and fed directly without preheating into the lower end of a reactor containing coal-derived liquid, dissolved hydrogen, and a bed of commercial particulate hydrogenation catalyst (American Cyanamid HDS-1442A). The reactor conditions are maintained at 830°-850° F. temperature and 2200 psig hydrogen partial pressure. The reactor temperature is maintained by heating recycled hydrogen and recycled hydrocarbon liquid each to a temperature sufficiently above the reactor temperature to provide the additional heat needed. The flow rates and heating temperature used and the product yields obtained are provided in Table 1.

TABLE 1

FEEDING COAL TO CATALYTIC REACTION ZONE WITHOUT PREHEATING

| | Standard Operation With Preheating | Operation Without Preheating Feed |
|---|---|---|
| Coal Feed, (m.a.f. basis), Lb | 100 | 100 |
| Reactor Temperature, °F. | 840 | 840 |
| Hydrogen Partial Pressure, psig | 2200 | 2200 |
| Coal-Oil Slurrying Temperature, °F. | 350 | 440 |
| Preheater Outlet Temperature, °F. | 700 | |
| Recycle Hydrogen Temperature, °F. | 750 | 1000 |
| Recycle Oil Temperature, °F. | 490 | 810 |
| Recycle $H_2$ Flow, lb. | 20 | 20 |
| Recycle Liquid Flow, lb. | 200 | 150 |
| Product Yields, lb/100 lb: | | |
| $C_1$-$C_3$ Gas | 7.9 | 7.7 |
| $C_4$-400° F. Naphtha | 20.1 | 19.6 |
| 400°-975° Liquid | 32.8 | 43.7 |
| $C_4$-975° F. Liquid | 52.9 | 63.3 |
| 975° F.$^{30}$ Residuum | 29.6 | 19.7 |
| Total Products | 90.4 | 90.7 |
| Water, CO, $CO_2$, $NH_3$, $H_2S$ | 15.1 | 14.7 |
| Percent m.a.f. Coal Conversion | 93.7 | 95.1 |

It is noted that when the coal-oil slurry is fed directly into the catalytic reactor at temperature below about 450° F. without using a conventional coal-oil preheating step, the additional heat needed in the reactor can be provided by heating the recycled hydrogen and hydrocarbon liquid streams. Also, for otherwise equivalent reaction conditions significantly increased yields of the desirable 400°-975° F. and $C_4$-975° F. boiling range liquid products are produced, along with decreased yield of the undesired heavy 975° F.+ residual oil material containing preasphaltenese and asphaltenes. In addition, the percent conversion of the coal to useful hydrocarbon gases and liquids is increased when the coal feed temperature into the reactor is maintained below about 600° F.

Although this invention has been described broadly and with reference to certain embodiments thereof, it will be understood that modifications and variations to the process can be made within the spirit and scope of the invention, which is defined by the following claims.

We claim:

1. A process for hydrogenation of coal to produce hydrocarbon liquid and gaseous products, comprising:

(a) pressurizing particulate coal which has been dried to a moisture content of less than about 5 W % and feeding it at temperature below about 600° F. directly, without further heating into a pressurized backmixed type reaction zone containing coal-derived liquid and hydrogen;

(b) passing the coal along with said coal-derived liquid and hydrogen upwardly through said reaction zone which is maintained at 700°-975° F. temperature and 1000-5000 psig hydrogen partial pressure to rapidly heat the cool and convert it to hydrogenated coal-derived material;

(c) heating recycle hydrogen and a recycle coal-derived hydrogen liquid normally boiling above about 550° F. to a temperature sufficient to maintain said reaction zone temperature and recycling the heated materials into the lower part of said reaction zone to maintain said temperature therein;

(d) withdrawing said hydrogen coal-derived material containing gas and liquid fractions from the upper part of said reaction zone, and phase separating said material into gaseous and liquid fractions;

(e) passing said liquid fraction from said phase separation to a liquid-solids separation step, from which an overhead liquid stream normally boiling above about 550° F. and containing a reduced concentration of particulate solids is heated to said temperature above the reaction zone before recycling said heated coal-derived liquid into the reaction zone; and (f) recovering hydrocarbon gas and increased yield of low boiling hydrocarbon liquid product from the process.

2. The process of claim 1, wherein the particulate coal feed is mixed with a coal-derived hydrocarbon slurrying liquid before pressurizing, and the resulting coal-liquid slurry mixture is fed without further heating directly into the lower of of said reaction zone.

3. The process of claim 2, wherein the coal-liquid slurry mixing temperature is 400°-575° F.

4. The process of claim 2, wherein the coal slurrying liquid has a normal boiling temperature range above about 600° F.

5. A process for catalytic hydrogenation of coal to produce hydrocarbon liquid and gaseous products, comprising:

(a) pressurizing particulate coal and feeding it at temperature below about 600° F. directly without further heating into a pressurized catalytic reaction zone containing coal-derived liquid and hydrogen and an ebullated bed of particulate hydrogenation catalyst;

(b) passing the coal along with said coal-derived liquid and hydrogen upwardly through said ebullated bed of particulate hydrocarbon catalyst, said bed being maintained at 700°-950° F. temperature and 1000-5000 psig hydrogen partial pressure to rapidly heat the coal and catalytically convert it to hydrogenated coal-derived material;

(c) heating recycle hydrogen and a recycle coal-derived hydrocarbon liquid normally boiling above about 550° F. to a temperature sufficient to maintain said reaction zone temperature and recycling the heated materials into the lower part of said reaction zone to maintain said temperature therein;

(d) withdrawing said hydrogenated coal-derived material containing gas and liquid fractions from the upper part of said reaction zone, and phase separating said material into gaseous and liquid fractions;

(e) passing that liquid fraction from said phase separation to a liquid-solids separation step, from which an overflow liquid stream normally boiling above about 550°0 and containing a reduced concentration of particulate solids is heated to said temperature above the reaction zone temperature before recycling said heated coal-derived liquid into the reaction zone; and (f) recovering hydrocarbon gas and increased yield of low boiling hydrocarbon liquid product from the process.

6. The process of claim 5, wherein the particulate coal is dried to moisture content less than about 5 W % before pressurizing and the coal is then fed directly into said catalytic reaction zone at substantially the drying temperature.

7. The process of claim 5, wherein the particulate coal feed is mixed with a coal-derived hydrocarbon slurrying liquid before pressurizing, and the resulting coal-liquid slurry mixture is fed without further heating directly into the lower part of said reaction zone.

8. The process of claim 7, wherein the coal-liquid slurry mixing temperature is 400°-600° F.

9. The process of claim 7, wherein the coal slurrying liquid has a normal boiling temperature range above about 600° F.

10. The process of claim 5, wherein the reaction zone conditions are maintained at 750°-900° F. temperature and 1000-4000 psig hydrogen partial pressure.

11. The process of claim 5, wherein the particulate coal is pressurized to reaction zone pressure in a screw type feeder before introducing the coal into the reaction zone.

12. The process of claim 11, wherein the pressurized coal is mixed with a heated recycle hydrocarbon liquid and the mixture of coal-liquid is then introduced into the reaction zone.

13. The process of claim 5, wherein the coal is butuminous type.

14. The process of claim 5, wherein the coal is subbituminous type coal.

15. The process of claim 5, wherein the coal is pressurized to reaction zone pressure using a screw type feeder and the pressurized coal is mixed with recycle hydrogen and recycle coal-derived hydrocarbon liquid normally boiling above about 550° F. before feeding the coal-hydrocarbon liquid mixture into said reaction zone.

16. A process for catalytic hydrogenation of coal to produce hydrocarbon liquid and gaseous products, comprising:

(a) mixing particulate coal with a hydrocarbon liquid to provide a flowable slurry and feeding the slurry at temperature of below about 600° F. directly without further heating into a pressurized catalytic reaction zone containing coal-derived liquid and hydrogen and an ebullated bed of particulate hydrogenation catalyst;

(b) passing the coal along with said coal-derived liquid and hydrogen upwardly through said ebullated bed of particulate hydrogenation catalyst, said bed being maintained at 700°–950° F. temperature and 1000–5000 psig hydrogen partial pressure to rapidly heat the coal and catalytically convert it to a hydrogenated coal-derived material;

(c) heating recycle hydrogen and a coal-derived hydrocarbon liquid normally boiling above about 600° F. to temperatures about 10° F.–100° F. above the reaction zone temperature and introducing the heated materials into the lower part of said reaction zone to maintain said temperature therein;

(d) withdrawing said hydrogenated coal-derived material containing gas and liquid fractions from the upper part of said reaction zone, and phase separating said material into gaseous and liquid fractions;

(e) passing said liquid fraction from said phase separation to a liquid-solids separation step, from which an overhead liquid stream normally boiling above about 650° F. and containing a reduced concentration of particulate solids is heated to said temperature above the reaction zone temperature before recycling the heated coal-derived liquid into the reaction zone; and (f) recovering hydrocarbon gas and increased yields of low boiling hydrocarbon liquid products from the process.

17. A process for catalytic hydrogenation of coal to product hydrocarbon liquid and gaseous products, comprising:

(a) pressurizing particulate coal in an extruder type feeder at temperature below about 600° F. and feeding the coal along with a hydrocarbon liquid directly into a pressurized catalytic reaction zone containing coal-derived liquid and hydrogen and an ebullated bed of particulate hydrogenation catalyst;

(b) passing the coal along with said coal-derived liquid and hydrogen upwardly through said ebullated bed of particulate hydrogenation catalyst, said bed being maintained at 700°–950° F. temperature and 1000–5000 psig hydrogen partial pressure to rapidly heat the coal and catalytically convert it to a hydrogenated coal-derived material;

(c) heating recycling hydrogen and a coal-derived hydrocarbon liquid normally boiling above about 650° F. to temperatures about 10° F.–100° F. above the reaction zone temperature and introducing the heated materials into the lower part of said reaction zone to maintain the desired temperature therein;

(d) withdrawing said hydrogenated coal-derived material containing gas and liquid fractions from the upper part of said reaction zone, and phase separating said material into gaseous and liquid fractions;

(e) passing said liquid fraction from said phase separation to a liquid-solids separation step, from which an overhead liquid stream normally boiling above about 550° F. and containing a reduced concentration of particulate solids is heated to said temperature above the reaction zone temperature before recycling the heated coal-derived liquid into the reaction zone; and (f) recovering hydrocarbon gas and increased yields of low boiling hydrocarbon liquid product from the process.

18. The process of claim 17, wherein a minor amount of coal-derived liquid is introduced into the extruder feeder at near its inlet end to provide a seal.

19. A process for hydrogenation of coal to produce hydrocarbon liquid and gaseous products; comprising:

(a) pressurizing particulate coal and feeding it at temperature below about 600° F. directly without further heating into a pressurized backmixed type reaction zone containing coal-derived liquid and hydrogen;

(b) passing the coal along with said coal-derived liquid and hydrogen upwardly through said reaction zone which is maintained at 700°–950° F. temperature and 1000–5000 psig hydrogen partial pressure to rapidly heat the coal and convert it to hydrogenated coal-derived material;

(c) heating recycle hydrogen and a recycle coal-derived hydrocarbon liquid normally boiling above about 550° F. to a temperature sufficient to maintain said reaction zone temperature and recycling the heated materials into the lower part of said reaction zone to maintain said temperature therein, said recycled hydrogen and coal-derived hydrocarbon liquid being heated separately before being introduced in separate streams into said lower part of said reaction zone;

(d) withdrawing said hydrogenated coal-derived material containing gas and liquid fractions from the upper part of said reaction zone, and phase separating said material into gaseous and liquid fractions;

(e) passing said liquid fraction from said phase separation to a liquid-solids separation step, from which an over-heat liquid stream normally boiling above about 550° F. and containing a reduced concentration of particulate solids is heated to said temperature above the reaction zone temperature before recycling said heated coal-derived liquid into the reaction zone; and (f) recovering hydrocarbon gas and increased yield of low boiling hydrocarbon liquid product from the process.

20. The process of claim 19, wherein the recycled hydrogen and coal-derived hydrocarbon liquid are mixed together and then heated before introducing the mixed heated streams into the lower part of said reaction zone to maintain said temperature therein.

21. A process for catalytic hydrogenation of coal to produce hydrocarbon liquid and gaseous products, comprising:

(a) pressurizing particulate coal and feeding it at temperature below about 600° F. directly, without further heating, into a pressurized catalytic reaction zone containing coal-derived liquid and hydrogen and an ebullated bed of particulate hydrogenation catalyst;

(b) passing the coal along with said coal-derived liquid and hydrogen upwardly through said ebullated bed of particulate hydrogenation catalyst, said bed being maintained at 700°–950° F. temperature and 1000–5000 psig hydrogen partial pressure to rapidly heat the coal and catalytically convert it to hydrogenated coal-derived material;

(c) heating recycle hydrogen and a recycle coal-derived hydrocarbon liquid normally boiling above about 500° F. to a temperature sufficient to maintain said reaction zone temperature and recycling the heated materials into the lower part of said reaction zone to maintain said temperature therein, said recycled hydrogen and coal-derived hydrocarbon liquid being heated separately before being introduced in separate streams into said lower part of said reaction zone;

(d) withdrawing said hydrogenated coal-derived material containing gas and liquid fractions from the upper part of said reaction zone, and phase separating said material into gaseous and liquid fractions;

(e) passing said liquid fraction from said phase separation to a liquid-solids separation step, from which an overhead liquid stream normally boiling above about 550° F. and containing a reduced concentration of particulate solids is heated to said temperature above the reaction zone temperature before recycling said heated coal-derived liquid into the reaction zone; and (f) recovering hydrocarbon gas and increased yield of low boiling hydrocarbon liquid product from the process.

22. The process of claim 21, wherein the particulate hydrogenation catalyst is selected from the group consisting of oxides of cobalt, iron, molybdenum, nickel, tin and mixtures thereof, deposited on a base material selected from the group consisting of alumina, magnesia, silica and combination thereof.

23. The process of claim 21, wherein the overflow liquid containing reduced solids concentration from said liquid-solids separation is heated to a temperature 10°–100° F. above the reaction zone temperature before introducing the heated coal-derived liquid into said reaction zone to help maintain said reaction zone temperature.

* * * * *